US006065321A

United States Patent [19]

Kosch et al.

[11] Patent Number: 6,065,321

[45] Date of Patent: May 23, 2000

[54] OUTLET FOR CONNECTING SPRAY NOZZLES AND DROP TUBES TO AN IRRIGATION PIPE

[75] Inventors: Alois J. Kosch, Columbus; Joel J. Ludwig, Fremont, both of Nebr.

[73] Assignee: Valmont Industries, Inc., Valley, Nebr.

[21] Appl. No.: 09/239,342

[22] Filed: Jan. 28, 1999

Related U.S. Application Data

[62] Division of application No. 08/962,193, Oct. 31, 1997.

[51] Int. Cl.[7] ..... B21D 28/28

[52] U.S. Cl. ..... 72/327; 72/334; 83/191; 83/188

[58] Field of Search ..... 72/334, 327, 333; 29/512; 83/191, 188, 54, 621

[56] References Cited

U.S. PATENT DOCUMENTS

| | | | |
|---|---|---|---|
| 3,677,578 | 7/1972 | Roos | 285/162 |
| 3,863,960 | 2/1975 | Andersson | 285/39 |
| 3,879,069 | 4/1975 | Oostenbrink | 285/162 |
| 4,795,100 | 1/1989 | Purtell et al. | 239/734 |
| 5,207,461 | 5/1993 | Lasko | 285/222 |

FOREIGN PATENT DOCUMENTS 1139435 1/1969 United Kingdom .

*Primary Examiner*—Rinaldi I. Rada
*Assistant Examiner*—Dominic Troiano
*Attorney, Agent, or Firm*—Zarley, McKee, Thomte, Voorhees & Sease; Dennis L. Thomte

[57] ABSTRACT

An outlet for connecting spray nozzles, drop tubes or the like to an irrigation pipe comprising a generally cylindrical-shaped member having an inner end, an outer end, an annular shoulder protruding outwardly therefrom between the inner and outer ends, and an internally threaded bore extending therethrough. When the outlet is positioned in an opening formed in an irrigation pipe, the annular shoulder of the outlet is in engagement with the exterior surface of the pipe. A machine is also disclosed for creating a plurality of horizontally spaced-apart bulged areas in the pipe with each of the bulged areas having a flat surface thereon. The machine includes a bulging punch which creates the bulged areas in the pipe. The machine further includes a punch for creating an outlet opening in the flat surface of the bulged area. The machine also includes means for installing the outlet in the opening and to flare the inner end of the outlet into mechanical engagement with the interior surface of the pipe around the opening created therein.

7 Claims, 11 Drawing Sheets

OUTLET FOR CONNECTING SPRAY NOZZLES AND DROP TUBES TO AN IRRIGATION PIPE

CROSS-REFERENCE TO RELATED APPLICATION

This is a divisional application of application Ser. No. 08/962,193 entitled AN OUTLET FOR CONNECTING SPRAY NOZZLE, DROP TUBES OR THE LIKE TO AN IRRIGATION PIPE filed Oct. 31, 1997.

BACKGROUND OF THE INVENTION

1. Field of the Invention

This invention relates to an outlet for connecting spray nozzles, drop tubes or the like to an irrigation pipe or the like and more particularly to an outlet which is mounted in openings formed along the length of the irrigation pipe. The spray nozzles or drop tubes are then threadably inserted into the outlet.

2. Description of the Related Art

In irrigation systems such as center pivot irrigation systems or linear move irrigation systems, the main pipeline or water supply pipe is supported on a plurality of spaced-apart drive towers. To facilitate the sprinkling or spraying of water onto the area to be irrigated beneath the irrigation system, a plurality of spaced-apart spray nozzles or sprinkler nozzles are connected to the water supply pipe. In some cases, the nozzles are positioned on the upper portion of the water supply pipe. In other instances, inverted, U-shaped drop tubes are used which extend from the water supply pipe to a location below the pipe with the lower end of the drop tube having a spray nozzle or sprinkler nozzle mounted thereon. Each of the nozzles or drop tubes is normally placed in communication with the interior of the water supply pipe by first punching or drilling an opening in the pipe at the desired location and then welding an internally threaded outlet to the exterior surface of the pipe so that the interior of the outlet communicates with the opening in the pipe, and then threadably inserting the nozzle or drop tube into the outlet. The above-described procedure is time-consuming, and is even more time-consuming when the nozzle or drop tube spacing is very close. Further, if the threads of the outlet should become damaged, it is necessary for the outlet to be cut from the pipe with a new outlet welded thereto. Further, it is believed that the welding of the outlets to the water supply pipe may weaken the pipe around the weld area. Additionally, if the outlets are welded to the pipe prior to the galvanizing operation, the outlet must be sealed during the galvanizing operation to keep the galvanizing material from coming into contact with the internal threads of the outlet. If the outlets are welded to the pipe after the galvanizing process, the welding damages the galvanizing material around the outlet, thereby creating an area for rust to form.

Prior art outlets have also been provided which are not welded to the pipe, but which are inserted into an opening formed in the pipe and then held in place by compression forces or the like. The problem with such prior art devices is to seal the insert or outlet to the pipe, since the pipe is cylindrical.

SUMMARY OF THE INVENTION

An outlet is disclosed for connecting spray nozzles, sprinkler nozzles, drop tubes, etc., to an irrigation pipe or the like. The irrigation pipe is first provided with a plurality of spaced-apart bulged portions formed therein along the length thereof. An opening is then formed in each of the flat areas of the bulged portions. The outlet is then inserted into the opening and the inner end of the outlet is flanged or flared outwardly with respect to the opening to provide a mechanical connection and fluid-tight seal between the outlet and the opening. A machine is described for creating the bulged portions, punching openings in the flat areas of the bulged portions, inserting the outlets into the openings, and flaring the inner ends of the outlets outwardly into engagement with the pipe around the opening. The machine includes novel means for centering the punching apparatus with respect to the pipe to enable the apparatus to compensate for expansion and contraction of the pipe caused by temperature differentials, etc.

A principal object of the invention is to provide an outlet for connecting spray nozzles, sprinkler nozzles, drop tubes or the like to an irrigation pipe or the like.

Still another object of the invention is to provide an irrigation pipe having plurality of horizontally spaced bulges formed therein with an opening being formed in each of the bulges, the openings having an outlet positioned therein.

Still another object of the invention is to provide an improved means for mounting an outlet on an irrigation pipe.

Still another object of the invention is to provide an apparatus for creating horizontally spaced-apart bulges along the length of an irrigation pipe.

Yet another object of the invention is to provide an apparatus for installing outlet on an irrigation pipe which eliminates the need for welding.

Still another object of the invention is to provide a means for mounting an outlet on an irrigation pipe which does not weaken the irrigation pipe itself.

These and other objects will be apparent to those skilled in the art.

DESCRIPTION OF THE PREFERRED EMBODIMENT

Figure 1:
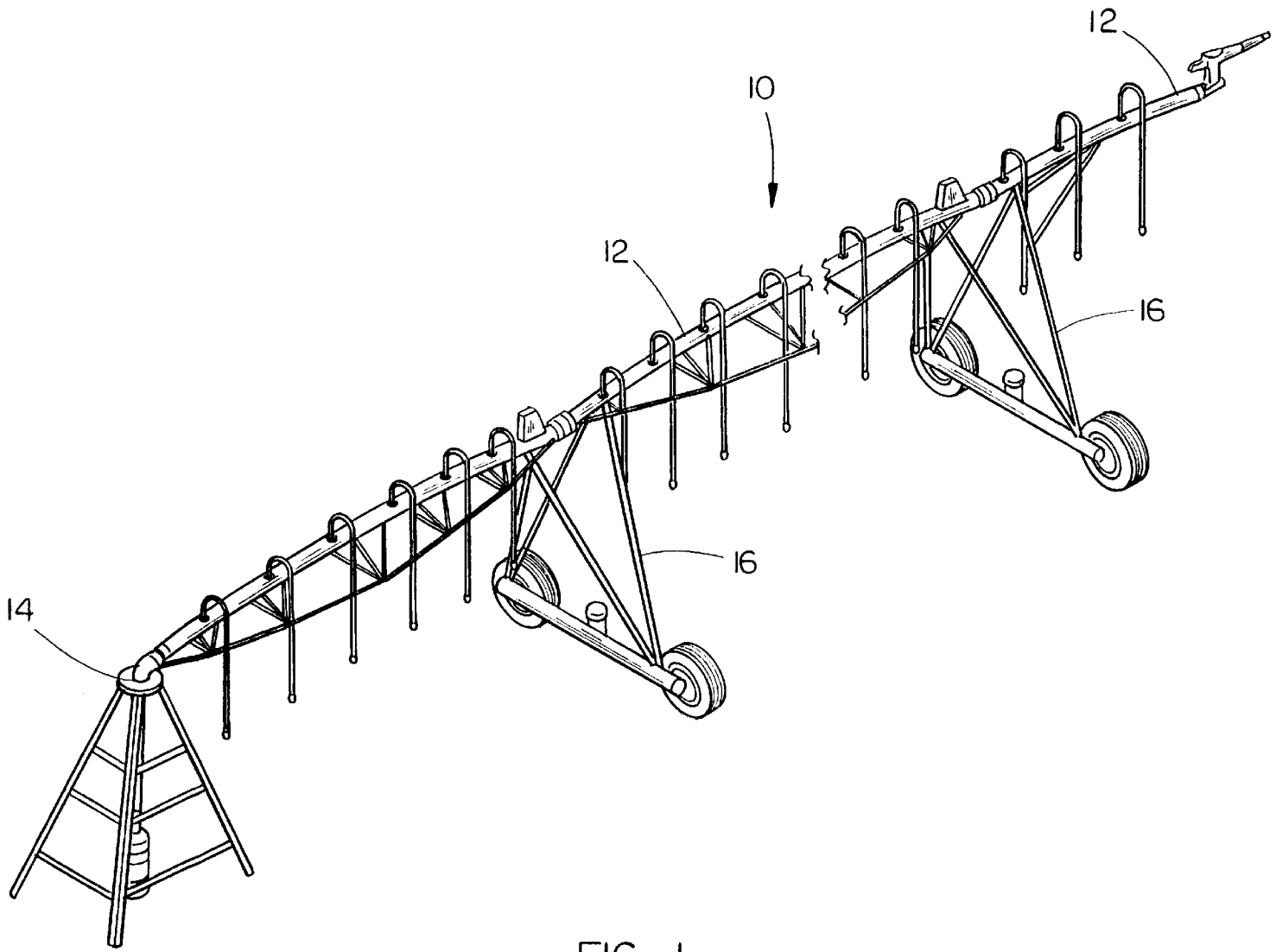
FIG. 1 is a partial perspective view of an irrigation system.

In FIG. 1, the numeral 10 refers to a conventional center pivot irrigation system including a plurality of main water supply pipes 12 extending outwardly from a pivot 14. The water supply pipes 12 are supported upon the drive towers 16 in conventional fashion. The irrigation system could also be of the linear type. Further, the irrigation pipes could rest on the ground if the system was not self-propelled.

In the prior art pipes 12, a plurality of horizontally spaced-apart openings are formed therein along the upper end thereof. In the prior art, an internally threaded metal coupling or outlet was welded to the exterior surface of the pipe at each of the openings so that the internally threaded bore of the outlet communicated with the opening formed in the pipe. Either the threaded portion of a spray nozzle would be threadably inserted into the prior art outlet or a drop tube threadably mounted therein. A problem associated with the prior art is that if the outlet is welded to the pipe after the galvanizing process, the welding will destroy the galvanizing material around the outlet, thereby creating an area for rust to form. If the outlets of the prior art are mounted on the irrigation pipe prior to the galvanizing process, the outlets have to be sealed to prevent the galvanizing material from coming into contact with the threads of the outlet. Further, in the prior art outlets wherein the outlet was force fitted or compressed into an opening formed in the pipe, difficulty was experienced in sealing the outlet to the pipe due to the cylindrical configuration of the pipe.

Figure 4:
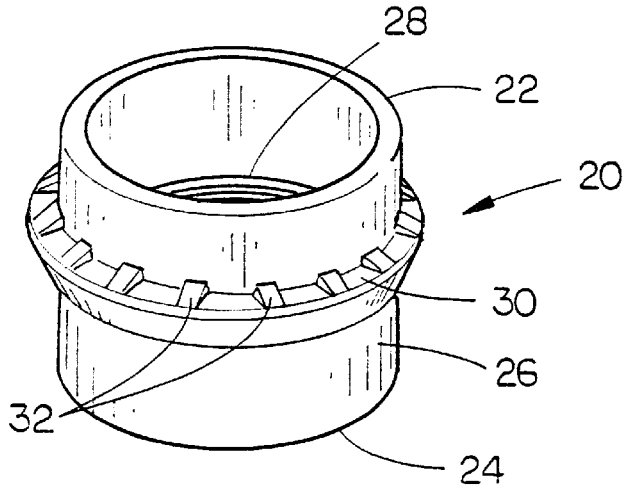
FIG. 4 is a perspective view of the outlet which is inserted into the opening of the bulged area of FIG. 3.

In an effort to overcome the disadvantages of the prior art, applicants have provided a novel outlet for installation on irrigation pipes and have provided an apparatus for creating horizontally spaced-apart bulges in the irrigation pipe so that the outlet may be properly installed on the irrigation pipe. In that regard, the numeral 20 refers generally to the outlet of this invention which is best seen in FIG. 4 prior to it being inserted into an opening in the irrigation pipe and prior to it being deformed into mechanical and sealing engagement with the pipe. As seen in FIG. 4, outlet 20 is generally cylindrical in shape and includes an inner end 22, outer end 24, exterior surface 26 and an internally threaded bore 28 provided therein. Outlet 20 is provided with an annular shoulder 30 which extends therearound and protrudes outwardly therefrom. Shoulder 30 is provided with a plurality of radially spaced-apart gripping teeth 32 which are adapted to engage the exterior surface of the irrigation pipe as will be described in more detail hereinafter.

Figure 3:
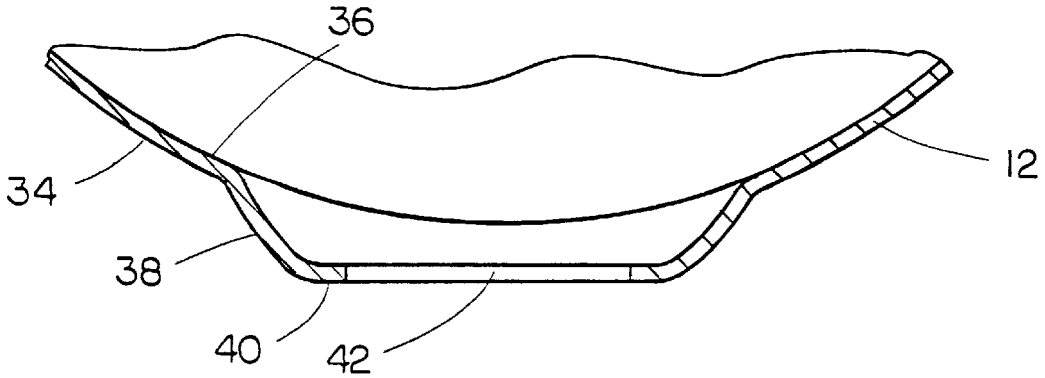
FIG. 3 is a transverse sectional view of an irrigation pipe having a bulged area created therein.
Figure 5:
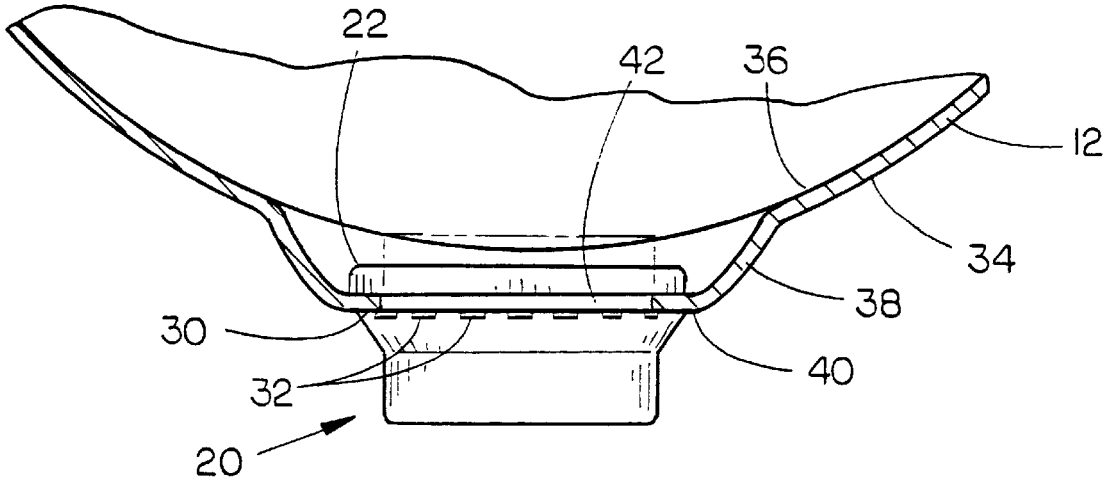
FIG. 5 is a view similar to FIG. 4 except that the outlet has been inserted into the opening in the irrigation pipe with the inner end then having been flanged or flared outwardly.
Figure 6:
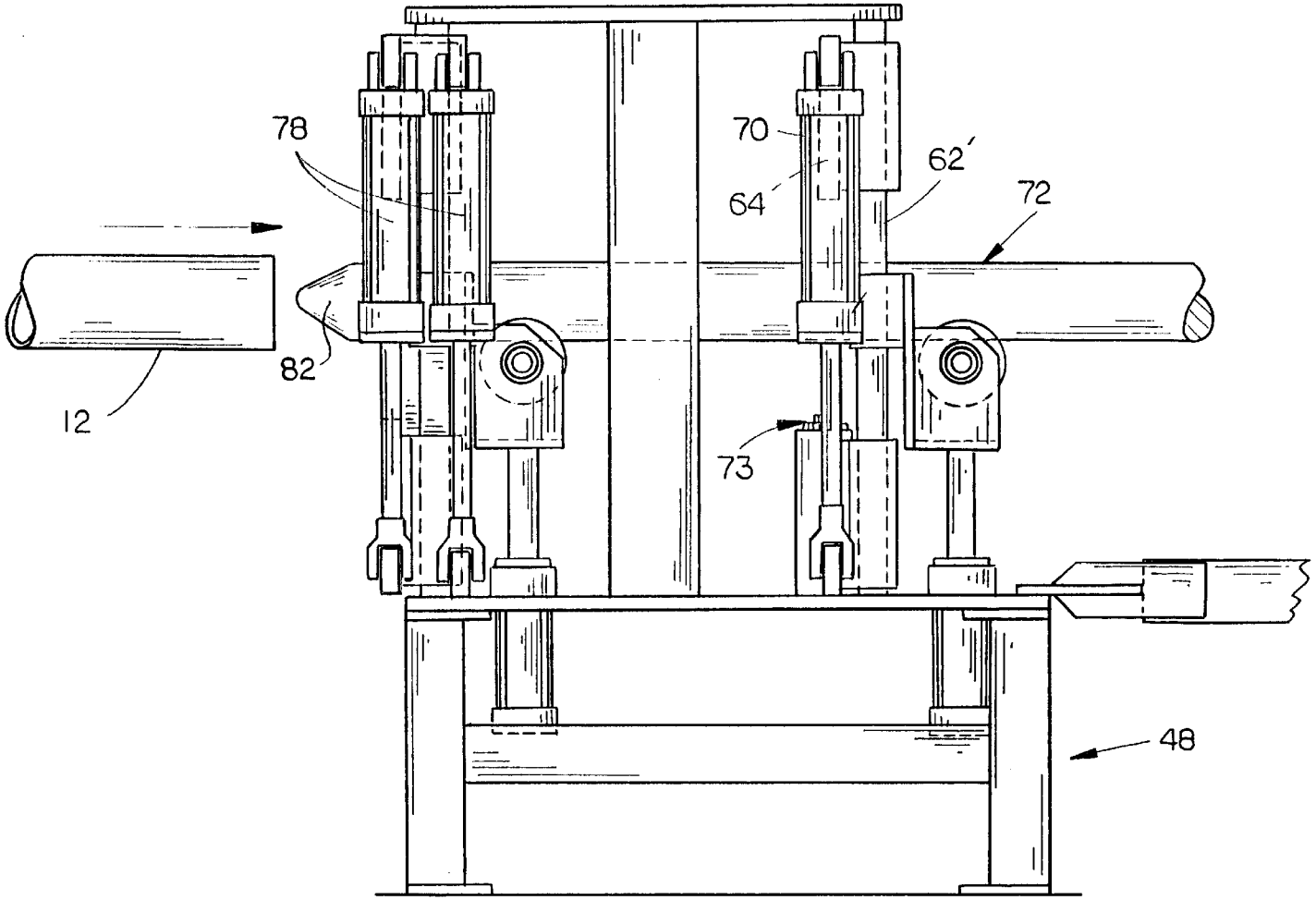
FIG. 6 is a side elevational view of the machine illustrating an irrigation pipe about to be inserted on the mandrel of the machine.
Figure 7:
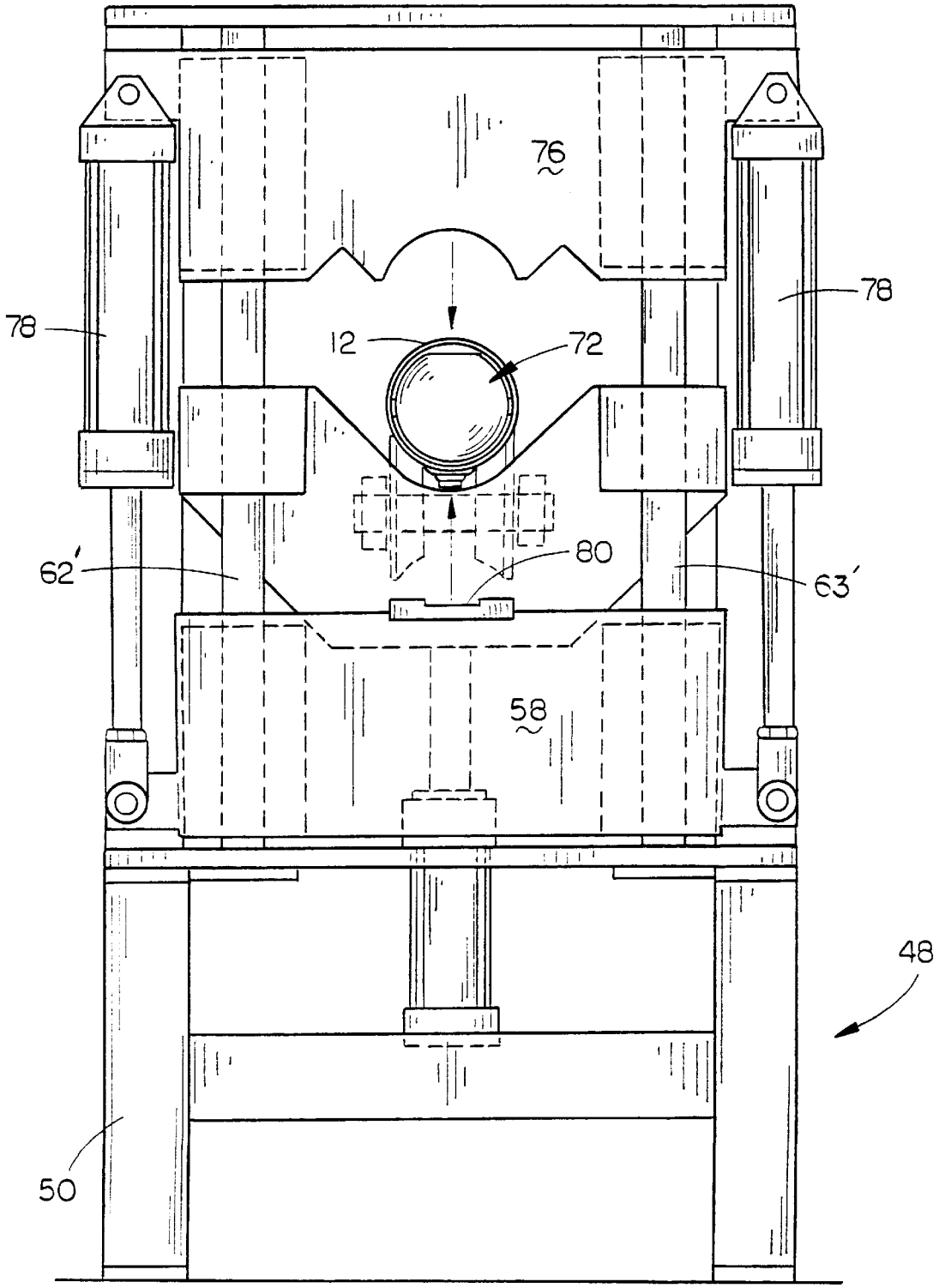
FIG. 7 is an end view of the apparatus of FIG. 6 illustrating an irrigation pipe initially inserted therein.

For purposes of discussion, the irrigation pipe 12 will be described as having an exterior surface 34 and an interior surface 36. Each of the pipes 12 is provided with a plurality of horizontally spaced-apart bulges 38 which have a flat surface 40. An opening 42 is formed in each of the bulges 38 by the apparatus referred to generally by the reference numeral 46. FIG. 5 illustrates the outlet 20 having been inserted in an opening 42 with the inner-end 22 having been forcibly deformed or flanged outwardly towards the interior surface of the flat surface 40 so that the outlet 20 is mechanically and sealably mounted in the opening 42. Although the drawings illustrate the bulges 38 to be formed in the underside of the pipe 12, flat surfaces 40 and openings 42 would normally be positioned at the upper end of the pipe so as to be able to receive nozzles or drop tubes therein. FIG. 1 illustrates drop tubes being threadably mounted in the openings. The reason for illustrating the bulges in the position in FIGS. 3 and 5 is that the bulges are created in the bottom or underside of the pipe in the machine 46 as will be described hereinafter.

Apparatus 46 generally includes a stationary lower support 48 including a plurality of support legs 50. For purposes of description, the numeral 52 will refer to the upstream side of the machine while the numeral 54 will refer to the downstream side of the machine. Piercing punch support 56 is positioned at the upstream side of the machine while flaring support frame 58 is positioned at the downstream side of the machine. The numeral 60 refers to a support that extends upwardly from lower support 48. A pair of vertically disposed guide rods 62 and 63 extend between supports 48 and 60, at the upstream side of the machine, as illustrated in the drawings. A pair of vertically disposed guide rods 62' and 63' extend between the supports 48 and 60 at the downstream side of the machine, as also illustrated in the drawings. Piercing punch support 56 is vertically movably mounted on the guide rods 62 and 63. A hold-down plate 64 is vertically movably mounted on the guide rods 62 and 63 above piercing punch support 56 and has an inverted semicircular opening 66 provided thereon. A pair of hydraulic cylinders 68 and 70 interconnect the vertically movable piercing punch support 56 and the vertically movable hold-down 64 for enabling the hold-down 64 to be lowered with respect to the mandrel 72 and so that piercing punch support 56 may be raised with respect to the mandrel 72. Piercing punch support 56 supports a piercing punch apparatus 73 as will be described in more detail hereinafter. The mandrel 72 is a long, hollow pipe-like member which is positioned in the apparatus, as illustrated in FIG. 2, and which has hydraulic lines and several other components mounted therein as will be described hereinafter.

Figure 2:
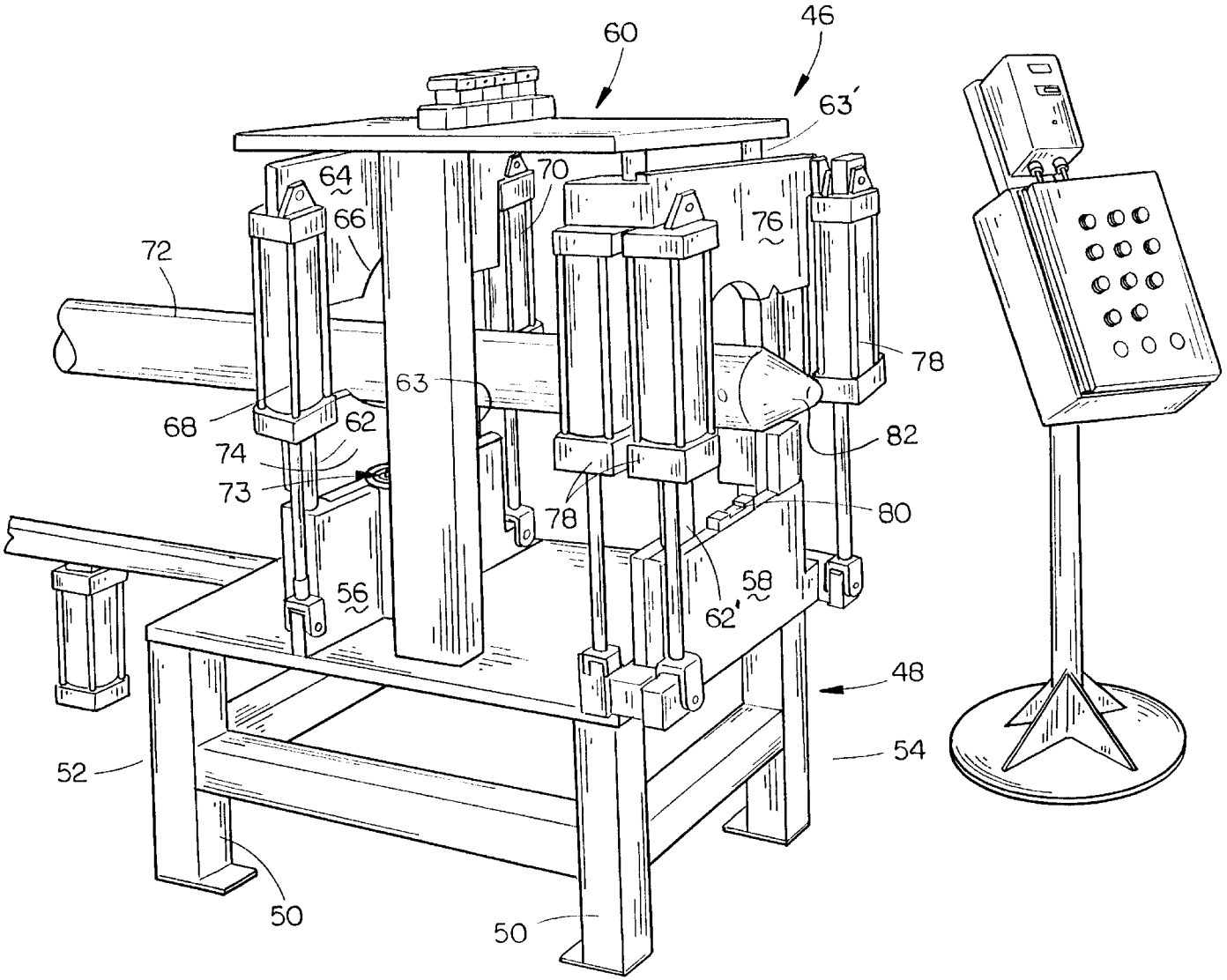
FIG. 2 is a perspective view of the machine or apparatus employed with this invention.

A hold-down plate 76 is vertically movably mounted on guide rods 62' and 63', as illustrated in FIG. 2, and the movement of the same is controlled by a plurality of hydraulic cylinders 78. Flaring support frame 58 is vertically movably mounted on guide rods 62' and 63' and is connected to the cylinders 78. Flaring support frame 58 has a flaring support 80 mounted thereon which will be described in more detail hereinafter.

Figure 8:
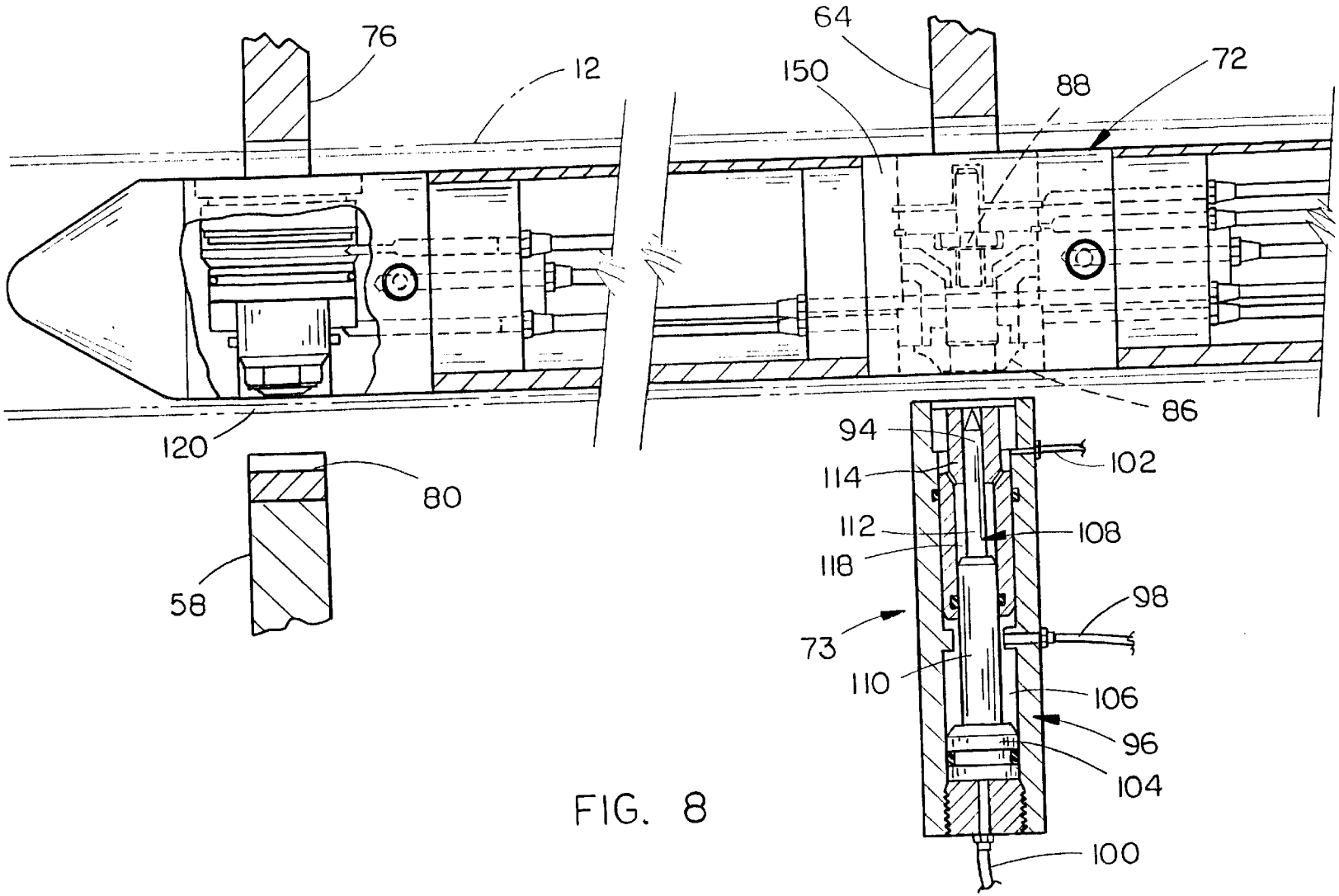
FIG. 8 is a partial side elevational view of the mandrel with portions thereof cut away to more fully illustrate the invention.
Figure 10:
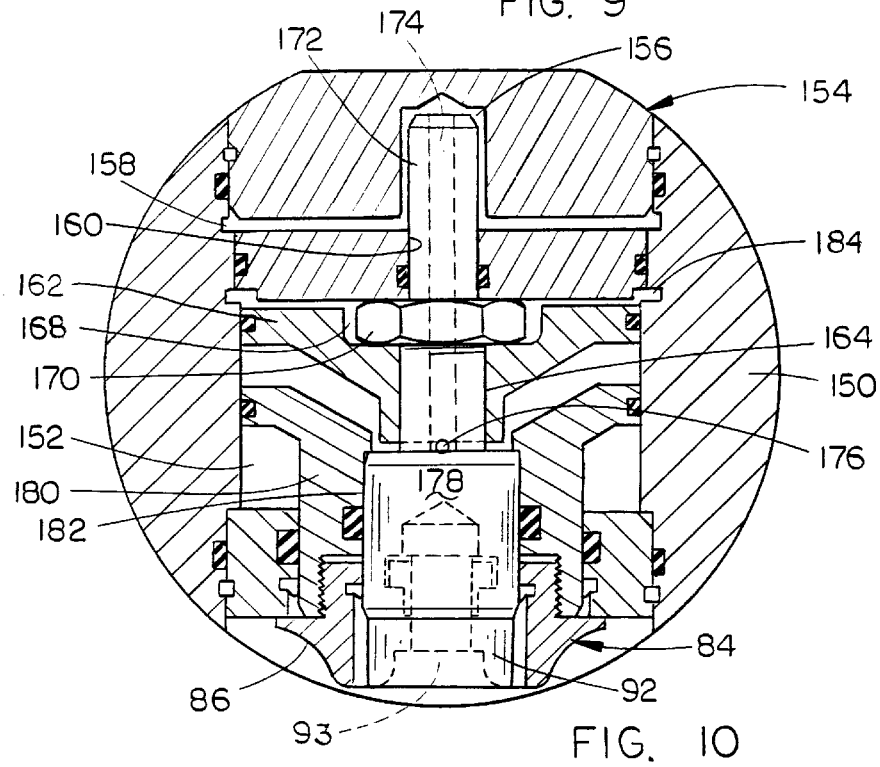
FIG. 10 is a partial vertical sectional view of the mechanism for cremating openings in the pipe.
Figure 11:
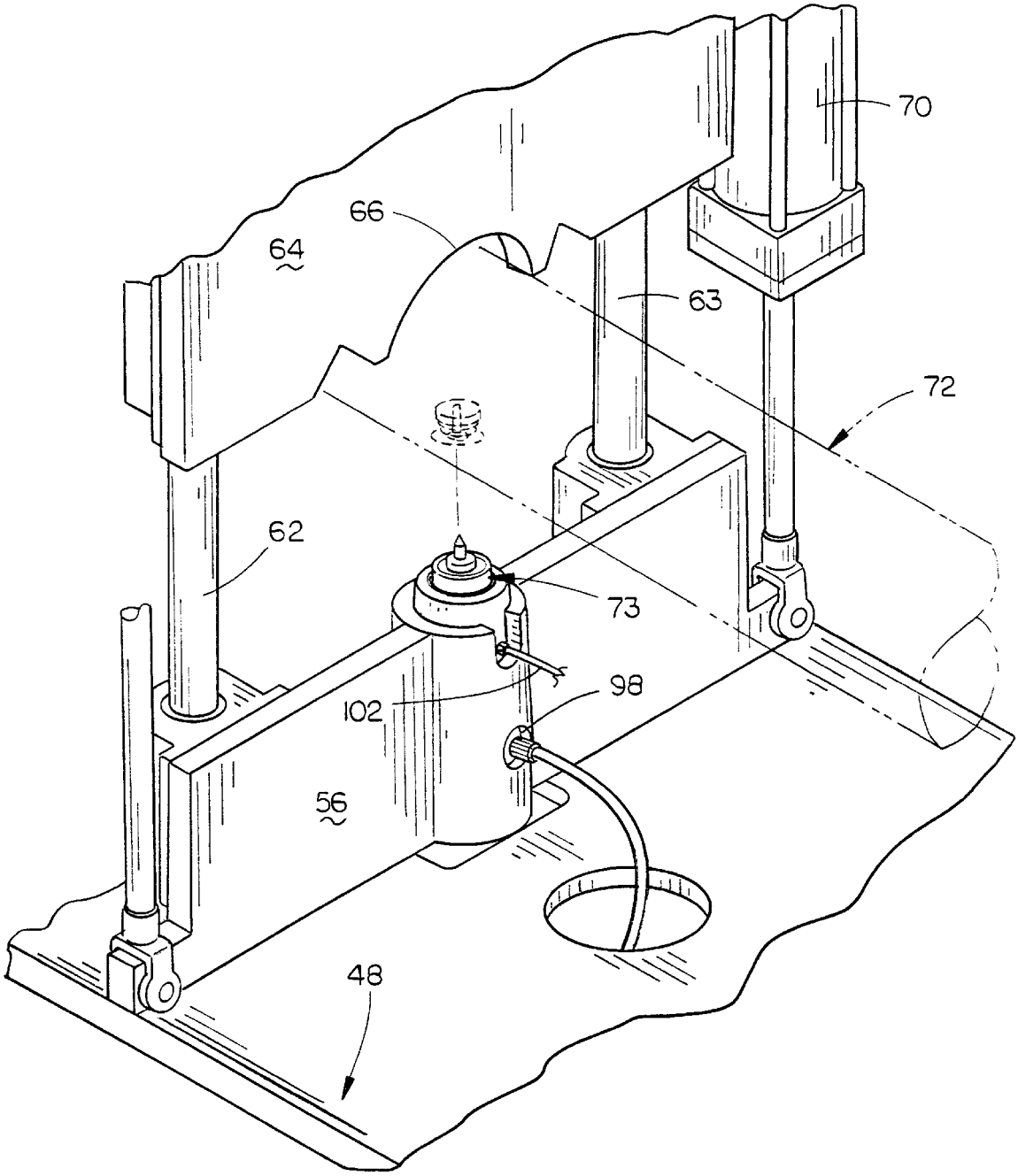
FIG. 11 is a perspective view of the punching mechanism of the invention.

As previously stated, mandrel 72 is elongated and hollow. The forward end 82 of mandrel 72 is cone-shaped and is positioned downstream of the frame 58 and hold-down 76. Mandrel 72 includes a pipe bulging and punching apparatus 84 therein which is vertically aligned with piercing punch apparatus 73. Pipe bulging and punching apparatus 84 includes a generally truncated cone-shaped bulging punch 86 which is vertically movably mounted in mandrel 72, as will be described hereinbelow. Pipe bulging and punching apparatus 84 is mounted in housing 150 located inside mandrel 72 (FIGS. 8, 10) and includes a vertically disposed central bore 152 formed therein. The upper end of bore 152 is closed by means of plug 154 having a vertically disposed upper bore 156 formed therein which is in communication with port 158 which is in communication with a source of hydraulic fluid. Plug 154 also includes a lower bore 160, as seen in FIG. 10. Punching piston 162 is vertically movably mounted in central bore 152 and has a bore 164 formed therein. The upper end of punching piston 162 is in communication with a port 184 which is in communication with a source of hydraulic fluid. The upper end of punching piston 162 is provided with a recess 16E formed therein which receives nut 170 mounted on rod 172 which is slidably received by bores 160 and 164. Rod 172 has an elongated bore 174 formed therein which extends downwardly therein from its upper end to the lower end thereof and which communicates with laterally extending ports 176 located immediately above piston 178 which is mounted on the lower end of rod 172 and which has a punch 92 mounted therein. Punch 92 has a piercing punch receiving opening 93 (FIG. 10) formed in its lower end thereof adapted to receive the piercing punch 94, as will be described hereinafter.

Bulging piston 180 is slidably mounted in bore 152 and has a bore 182 which slidably receives piston 178, as seen in FIG. 10. A return port (not shown) is provided which is in communication with bore 152 below the upper end of piston 180 and which is in communication with a source of hydraulic fluid under pressure.

Piercing punch apparatus 73 generally includes a cylindrical housing 96 having hydraulic fluid inlets 98 and 100 extending thereinto. Housing 96 also includes an air inlet 102 formed therein which is in communication with a source of low pressure air. Piston 104 is vertically movably mounted in chamber 106 and has piercing punch 108 mounted thereon for movement therewith. Piercing punch 108 includes punch portions 110 and 112, as seen in the drawings. The upper end of punch portion 112 is pointed and is adapted to pierce the wall of the irrigation pipe and be received by the lower end of punch 92. Piercing punch 108 is movably mounted in sleeve 114 which has bores 116 formed therein which provide communication between chamber 118 in sleeve 114 and the upper end of the housing 96 to permit the air in chamber 118 to be exhausted when piston 104 is moved upwardly and to permit air to enter chamber 118 when piston 104 is lowered.

Figure 12:
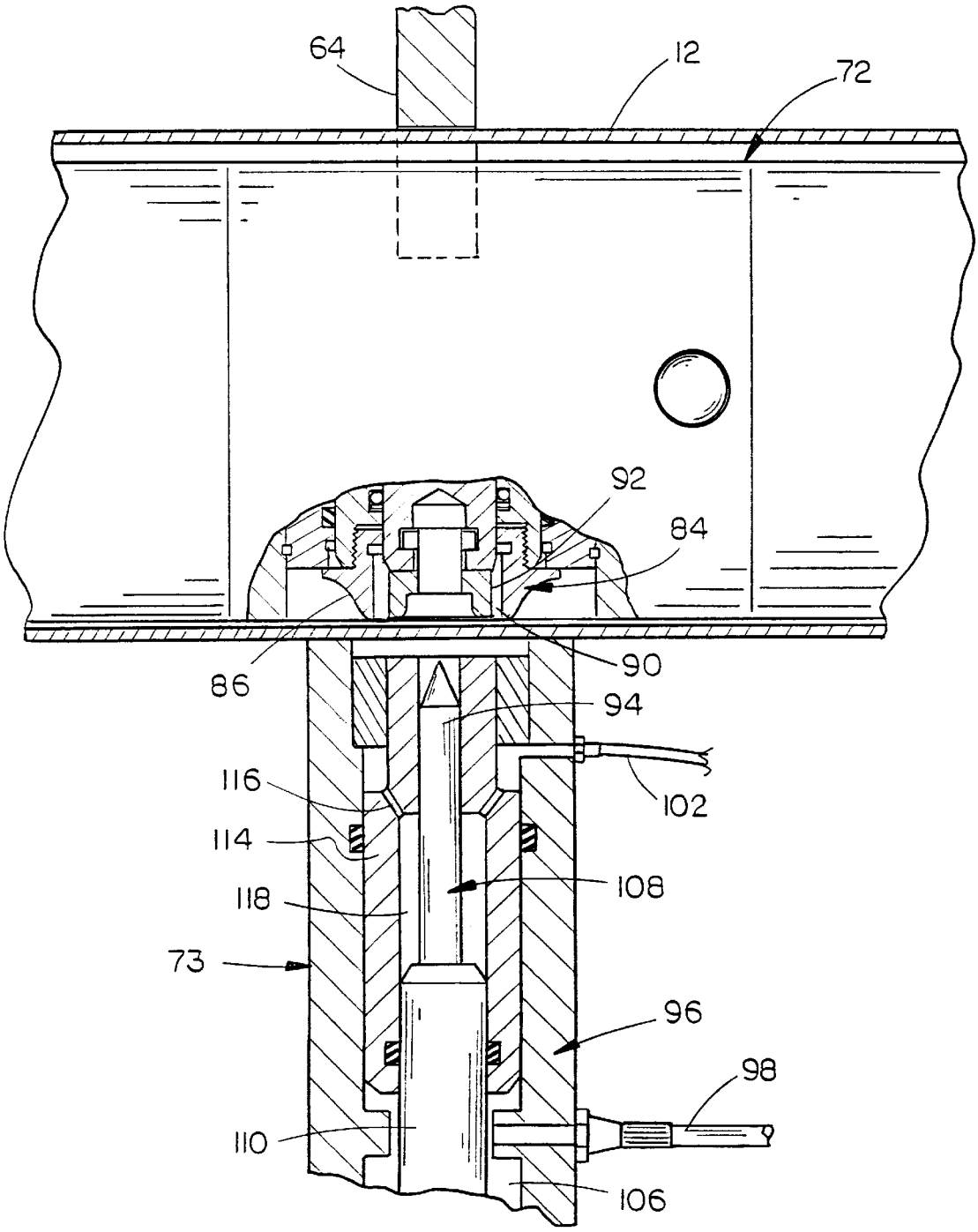
FIG. 12 is a sectional view of the punching mechanism of FIG. 11.
Figure 13:
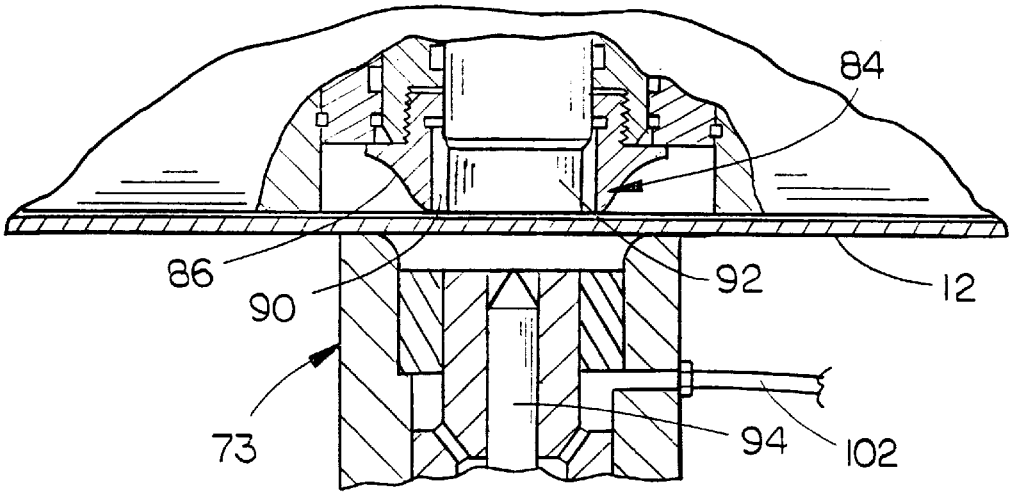
FIGS. 13–15 are sectional views illustrating the sequential operation of the punching mechanism.
Figure 14:
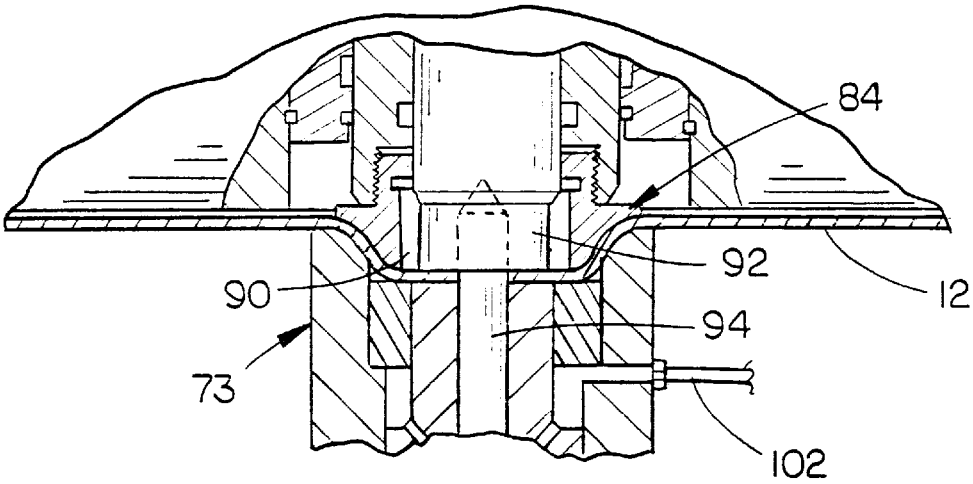
Figure 15:
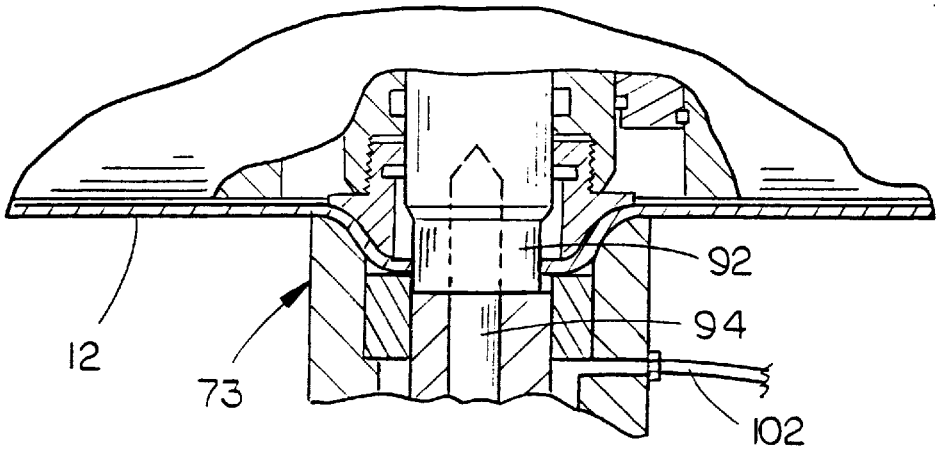

The bulging, piercing and punching operation is as follows. When a pipe 12 has been properly positioned on mandrel 72, piercing punch support 56 is raised upwardly to the position of FIG. 12 and hold-down plate 64 is lowered to the position of FIG. 12. Hydraulic fluid under pressure is then introduced into bulging and punching apparatus 84 through the port 158 and port 184. The fluid passes inwardly to the bore 156, thence upwardly therein, and thence downwardly through bore 174 in rod 172. The fluid exits bore 174 through the ports 176 and moves into the space between punching piston 162 and bulging piston 180 which causes bulging piston 180 to move downwardly in tandem with punch piston 162 so that the bulging punch 86 bulges the pipe to create the bulge described hereinbefore.

Hydraulic fluid under pressure is introduced into piercing punch apparatus, 73 by means of inlet 100 which forces piston 104 upwardly, thereby causing piercing punch 94 to pierce through the pipe 12. Piercing punch 94 is received by the lower end of opening 90 in punch 92. As piercing punch 94 enters the opening 90, the punch 92 will float laterally to align itself with the piercing punch 94. The lateral floating action of punch 92 is achieved by providing certain tolerances between the parts of the apparatus, namely between the piston 178 and the punch 92. After the piercing punch 94 has properly aligned the punch 92, hydraulic fluid under pressure is introduced into port 184, while exhausting port 158, which causes punching piston 162 move downwardly which causes piston 178 to also move downwardly, thereby moving punch 92 downwardly through pipe 12 around the piercing punch 94 to create the opening 42 in pipe 12. When the opening 42 has been formed, fluid under pressure is introduced into chamber 152 which causes the bulging punch 86 and punch 92 to retract. The piercing punch support 56 is lowered and the hold-down plate 64 is raised. The slug formed by the piercing and punching operation is removed from the piercing punch by retracting piston 104 and by moving sleeve 114 upwardly through the introduction ol hydraulic fluid into piercing punch apparatus 73 through inlet 98. A small amount of air is continually introduced into apparatus 73 by means of the air inlet 102 to blow dust and debris from the upper portion of the apparatus 73.

Figure 16:
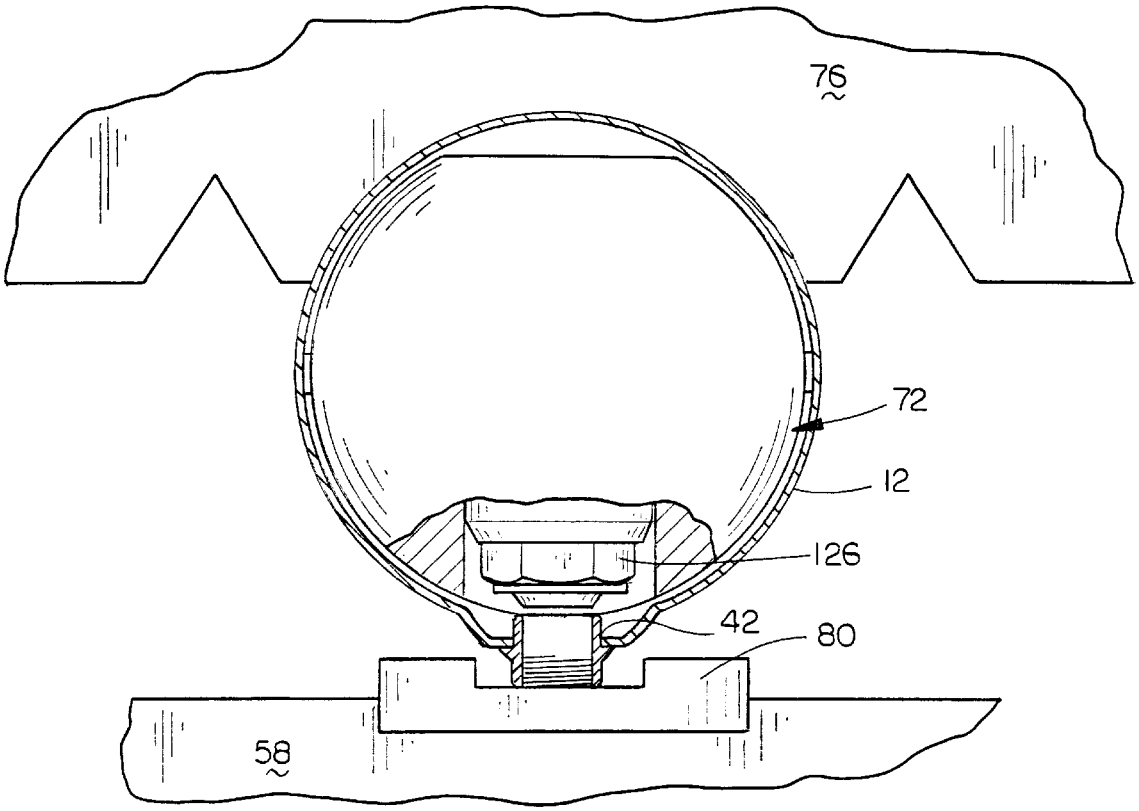
FIG. 16 is a sectional view illustrating the outlet positioned in an opening in the irrigation pipe.

The pipe 12 is then advanced in the machine 46 so that the newly created opening 42 is positioned over the flaring support 80, which is initially spaced below the pipe 12. An outlet 20 is then placed in the opening 42 (FIG. 16) and the flaring support 80 is raised to the position of FIG. 16 so that the outlet flaring apparatus 120 positioned in mandrel 72 may secure the outlet 20 in the opening 42 in a mechanically secure and fluid-tight condition. After the outlet 20 has been installed on the pipe 12, flaring support 80 is lowered.

Figure 9:
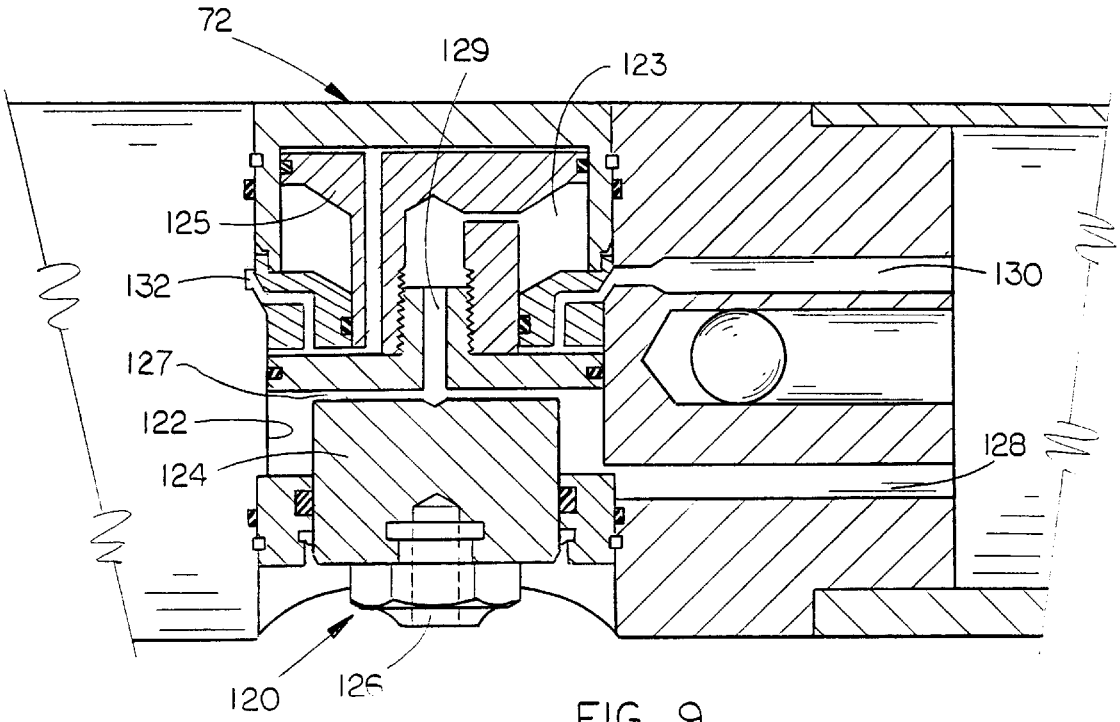
FIG. 9 is a partial vertical sectional view of the outlet flaring mechanism.
Figure 17:
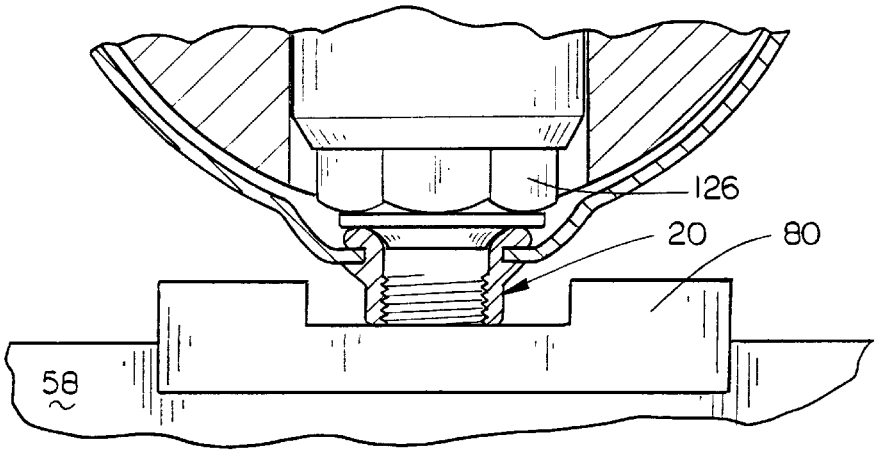
FIG. 17 is a view similar to FIG. 16 except that the inner end of the outlet has been flared outwardly to secure the outlet to the irrigation pipe.

As seen in FIG. 9, mandrel 72 includes bores 122 and 123 formed therein having vertically movable pistons 124 and 125 mounted therein. Piston 124 has a flaring tool 126 mounted thereon, as seen in FIG. 9. Hydraulic fluid is introduced into port 127 by means of port 128. The hydraulic fluid passes upwardly through bore 129 into the bore 123 below the piston 125 to return the pistons 124 and 125 to the position of FIG. 9. Hydraulic fluid is introduced into bores 122 and 123 above pistons 124 and 125 through ports 130 and 132 to cause pistons 124 and 125 to be lowered so that the flaring member 126 will engage the outlet 20, as seen in FIG. 17, to mechanically secure the outlet 20 to the pipe 12.

After installation of the outlet 20 on the pipe 12, the gripping teeth 32 will be in engagement with the exterior surface of the pipe to prevent inadvertent rotation of the outlet 20 with respect to the pipe such as when a nozzle or drop tube is threadably inserted into the outlet 20.

Thus it can be seen that the invention accomplishes at least all of its stated objectives.

We claim:

1. An apparatus, for preparing a pipe for installation of an outlet thereon, comprising:

a support frame;

an elongated, horizontally disposed, cylindrical mandrel positioned in said support frame for supporting the pipe to be prepared thereon;

said mandrel having a pipe bulging punch vertically movably mounted therein for creating a bulged area in the pipe;

said pipe bulging punch being configured so as to create a flat surface on said bulged area;

said mandrel having a vertically movable punch mounted therein for punching an outlet opening in the pipe;

said vertical movable punch comprising a piercing punch support vertically movably mounted on said support frame and being movable from a first position spaced from the pipe supported on said mandrel to a second position adjacent the pipe support on said mandrel; means for moving said piercing punch support between its said first and second positions; a piercing punch vertically movable between a retracted position to an extended punching position for punching an opening in the flat surface of the bulged area; said mandrel having a vertically movable punch mounted thereon for punching an opening in the pipe concentric with the opening created by said piercing punch.

2. The apparatus of claim 1 wherein said vertically movable punch on said mandrel is axially positioned within said pipe bulging punch.

3. The apparatus of claim 2 wherein said vertically movable punch has a piercing punch receiving opening formed therein for receiving said piercing punch therein to align said vertically movable punch with said piercing punch.

4. The apparatus of claim 3 wherein said vertically movable punch is supported on said mandrel in a horizontally floating manner to allow for deflection of said piercing punch.

5. An apparatus for preparing a pipe for installation of an outlet thereon, comprising:

a support frame;

an elongated, horizontally disposed, cylindrical mandrel positioned in said support frame for supporting the pipe to be prepared thereon;

said mandrel having a pipe bulging punch vertically mounted on pistons therein for creating a bulged area in the pipe;

said pipe bulging punch being configured so as to create a flat surface on said bulged area;

said mandrel having a vertically movable punch mounted on pistons therein for punching an outlet opening in the pipe.

6. An apparatus for preparing a pipe for installation of an outlet thereon, comprising:

a support frame;

an elongated, horizontally disposed, cylindrical mandrel positioned in said support frame for supporting the pipe to be prepared thereon;

said mandrel having a pipe bulging punch vertically movably mounted therein for creating a bulged area in the pipe;

said pipe bulging punch being configured so as to create a flat surface on said bulged area;

said mandrel having a vertically movable punch mounted therein for punching an outlet opening in the pipe;

an outlet installation station being provided on said support frame for installing an outlet in the opening formed in the bulged area in the pipe; and said mandrel including a vertically movable flaring tool mounted therein for engaging an inner end of an outlet positioned in the opening formed in the pipe and to flare the inner end of the outlet into secure engagement with the pipe around the opening.

7. The apparatus of claim 6 wherein said mandrel includes a vertically movable flaring tool mounted therein for engaging an inner end of an outlet positioned in the opening formed in the pipe and to flare the inner end of the outlet into secure engagement with the pipe around the opening.

* * * * *